US011857820B2

(12) United States Patent
Nieman

(10) Patent No.: US 11,857,820 B2
(45) Date of Patent: Jan. 2, 2024

(54) GRIP AND TWIST ISOMETRIC WORKOUT TOOL

(71) Applicant: Chris Nieman, Libertyville, IL (US)

(72) Inventor: Chris Nieman, Libertyville, IL (US)

( * ) Notice: Subject to any disclaimer, the term of this patent is extended or adjusted under 35 U.S.C. 154(b) by 239 days.

(21) Appl. No.: 17/307,876

(22) Filed: May 4, 2021

(65) Prior Publication Data

US 2022/0355149 A1 Nov. 10, 2022

(51) Int. Cl.

| | |
|---|---|
| ***A63B 21/002*** | (2006.01) |
| ***A63B 21/00*** | (2006.01) |
| ***A63B 21/02*** | (2006.01) |
| ***A63B 21/05*** | (2006.01) |
| ***A63B 23/035*** | (2006.01) |
| ***A63B 23/12*** | (2006.01) |
| ***A63B 21/015*** | (2006.01) |

(52) U.S. Cl.

CPC .... *A63B 21/0023* (2013.01); *A63B 21/00069* (2013.01); *A63B 21/015* (2013.01); *A63B 21/023* (2013.01); *A63B 21/05* (2013.01); *A63B 21/4035* (2015.10); *A63B 21/4049* (2015.10); *A63B 23/03533* (2013.01); *A63B 23/12* (2013.01)

(58) Field of Classification Search

CPC ..... A63B 21/015; A63B 21/0023; A63B 21/00069; A63B 21/023; A63B 21/05; A63B 21/4035; A63B 21/4049; A63B 23/14; A63B 23/03533; A63B 23/12

See application file for complete search history.

(56) References Cited

U.S. PATENT DOCUMENTS

| | | | | |
|---|---|---|---|---|
| 3,830,493 A * | 8/1974 | Miller | A63B 23/14 | 482/46 |
| 4,337,937 A * | 7/1982 | Lopez | A63B 23/14 | 403/379.3 |
| 4,643,417 A * | 2/1987 | Nieman | A63B 21/00069 | 482/46 |
| 5,776,034 A * | 7/1998 | Stamler | A63B 23/14 | 482/45 |

* cited by examiner

*Primary Examiner* — Joshua Lee

(74) *Attorney, Agent, or Firm* — Cynthia Lamon; Lamon Patent Serives

(57) ABSTRACT

An isometric force resistant exercise tool has a left handle form interfaced to a right handle form over an axle shaft locked to the right handle form, the axle shaft supporting a pressure plate, a compress able spring or set of springs, and a compression adjustment handle threaded onto the axle shaft and abutting the compress able spring or spring set, the pressure plate adjacent in assembly to a friction-resistive material fixed on the left handle form, the left handle form including a piston form interfacing with a ring housing on the right handle form, the piston form adjacent in assembly to a friction-resistive material fixed on the right handle form. Gripping the handle forms and rotating the against force resistance exercises one or more muscle groups.

20 Claims, 7 Drawing Sheets

GRIP AND TWIST ISOMETRIC WORKOUT TOOL

CROSS-REFERENCE TO RELATED DOCUMENTS

[NA]

BACKGROUND OF THE INVENTION

1. Field of the Invention

The present invention is in the field of isometric resistance exercise devices or tools and pertains particularly to methods and apparatus for working the arms, hands, wrists, shoulders, and fingers.

2. Discussion of the State of the Art

In the art of isometric muscle exercises, there are many types of exercise resistance devices or tools. The concept of working muscles against resistance is quite common and includes forms of weightlifting like curls, forms of band stretching like leg extending, forms of shoulder strengthening, etc.

A challenge in the art is that many band resistant tools or flexible ring tools that are gripped on opposite sides are narrow in general scope relative to which muscle groups can be worked, often requiring a person who wishes to work on multiple muscle groups, for example, arm, wrist, fingers, and shoulders to have handy several differing devices. Another challenge is that these tools are not readily adjustable relative to set resistance force in a way that provides a seamless graduation from little or no resistance upward on a scale to maximum resistance.

Many resistance tools that are adjustable require manual disassembly of one or more components and reassembly of those components to present an altered level of force resistance of the tool. Additionally, most bans resistant tools are restricted as to turn ratio, wherein only a single rotation may be made in one direction or another, while maintaining constant and consistent resistance. Other challenges with current art isometric exercise equipment are materials related, simply that many materials used for bands and core flexibility rings, for example, are subject to damage by the sun and undesirable changes (weakening) in resistance capability of the device due to repetitive use or overuse over an extended time. Therefore, what is clearly needed is a grip and twist apparatus that eliminates or reduces the challenges in the art cited above.

BRIEF SUMMARY OF THE INVENTION

According to an embodiment of the present invention, an isometric exercise tool is provided including an elongate left handle form having a central opening placed longitudinally there through and a bore space provided concentric with the through opening, the bore space opening out at one end of the handle form and terminating before the interfacing end of the handle form, the left handle form including a piston form serving as the interfacing end of the handle form, an elongate right handle form having a central opening placed longitudinally there through and a bore space provided concentric with the through opening, the bore space opening out at one end of the handle form and terminating before the interfacing end of the handle form, the right handle form including a ring housing serving as the interfacing end of the handle form, the ring housing having an inside diameter larger than the outside diameter of the piston form to receive the piston form concentrically therein, an axle shaft disposed longitudinally through the central openings through the left and right handle forms, the axle shaft including an external thread pattern disposed at one end and a pressure plate having a central opening placed there through disposed at the other end, the pressure plate disposed over the axle shaft orthogonal to the axle shaft and welded or otherwise fixed thereto, at least one compress able spring or set of compress able springs having an outer diameter just smaller than the inner diameter of the bore space of the right handle form, the spring or spring set fitted over the axle shaft at the threaded end, an adjustment turn handle including a handle knob and a smaller diameter handle stem with a central opening placed there through the center opening including a female thread pattern matching the external thread pattern on the axle shaft, and a friction-resistive material disposed to and fixed around the bottom of the bore space in the left handle form and disposed to and fixed around the bottom of the ring housing of the right handle form, whereby an operator may set the level of resistive force of the exercise tool by advancing the adjustment handle a distance over the thread pattern on the axle shaft to compress the spring or spring set roughly the same distance, the compression force translating through the axle shaft to the piston form and pressure plate in tandem causing directly proportional compression force of the piston form and pressure plate against the disposed friction-resistive materials.

In one embodiment, the left and right handle forms are tapered conically downward from the interface in assembly to the free ends of the handle forms. In one embodiment, the axle shaft includes a catch pin pressed or otherwise inserted through an opening placed orthogonally through the axle shaft and fixed thereto, the length thereof extending past the diameter of the axle shaft on opposite sides, and a catch pin slot provided in the bottom center of the ring housing on the right handle form, the catch pin slot extending a depth into the material and having a sufficient slot length and slot width to receive the catch pin locking the right handle form to the axle shaft and preventing rotation of the handle form about the axle shaft.

In one embodiment, the exercise tool further includes an annular sleeve having a cut length, an outside diameter, and a wall thickness, and a washer having an outside diameter similar to or the same as the annular sleeve, a thickness, and an inside diameter just larger than the outside diameter of the axle shaft the sleeve inserted into the bore space of the right handle form followed by the washer the aggregate serving as a filler of space in the bore and a hard stop against the spring or spring set.

In one embodiment, the handle stem of the adjustment turn knob includes a plurality of ring grooves having a uniform depth and placed about the outer surface of the handle stem the grooves equally spaced apart along the handle stem to mark off travel distance of the adjustment handle.

In one embodiment, the friction-resistive materials are rings having an outside diameter, an inside diameter, and a thickness, the rings fixed in place at the bottom of the center bore of the left handle form opposite the pressure plate of the axle shaft, and at the bottom of the ring housing of the right handle form opposite the piston form of the left handle form. In one embodiment, the resistive material is a fibrous synthetic rope material. In another embodiment, the friction resistive material is a solid form of material having friction resistive attributes or characteristics. In a variation of the embodiment, the resistive material disposed in the left handle form bore space is seated into an annular depression at the bottom of the center bore.

In one embodiment, the isometric exercise tool further includes a frictional bearing unit disposed over the axle shaft, the bearing unit comprising two washers and a bearing plate disposed there between, the bearing unit abutting the end of the handle stem of the adjustment handle on one side and the spring or spring set on the other side.

In one embodiment, there is a spring set including a large diameter spring placed over a smaller diameter spring, the smaller diameter spring having a longer overall uncompressed length than that of larger diameter spring. In one embodiment, the left handle form, the right handle form, and the adjustment handle are fabricated of a lightweight aluminum material. In a variation of this embodiment, the left handle form, right handle form, and adjustment handle have knurled outer peripheral surfaces. In a preferred embodiment, the force resisted is a bidirectional twisting force exerted upon the left and right handle form.

According to an aspect of the present invention, a method is provided for exercising one or more muscle groups using an isometric exercise tool, the isometric exercise tool having a left handle form interfaced to a right handle form over an axle shaft locked to the right handle form, the axle shaft supporting a pressure plate, a compress able spring or set of springs, and a compression adjustment handle threaded onto the axle shaft and abutting the compress able spring or spring set, the pressure plate adjacent in assembly to a friction-resistive material fixed on the left handle form, the left handle form including a piston form interfacing with a ring housing on the right handle form, the piston form adjacent in assembly to a friction-resistive material fixed on the right handle form, the method including (a) turning the compression adjustment handle to advance the handle along the threads of the axle shaft the compression handle compressing the spring or spring set to compress the pressure plate and piston form in tandem against the friction resistive materials, (b) gripping the left handle form and the right handle form and twisting the forms in opposite direction, (c) determining if the level of force resistance set by the adjustment handle is correct for the exercise, (d) if the level of force resistance set in (c) is not correct, advancing or retarding the compression adjustment handle and repeating step (b), and (e) if the level of force resistance set in (c) or corrected in (d) is correct, repeating step (b) for a number of repetitions.

In one aspect of the method, the friction-resistive materials are rings having an outside diameter, an inside diameter, and a thickness, the rings fixed in place at the bottom of a center bore of the left handle form opposite the pressure plate of the axle shaft, and at the bottom of the ring housing of the right handle form opposite the piston form of the left handle form. In one aspect of the method, there is a spring set including a large diameter spring placed over a smaller diameter spring over the axle shaft, the smaller diameter spring having a longer overall uncompressed length than that of larger diameter spring. In one aspect, in (a) the handle is turned clockwise to increase compression.

In one aspect of the method in (c) the determination of the level of force resistance is made as a result of practicing (b) ad mentally quantifying the force resistance level. In one aspect of the method, (b) is bypassed in process and determination of the level of force resistance in (c) is achieved by visualizing a linear gauge of equally spaced grooves provided about a stem of the adjustment handle the grooves subsequently aligning with the end of the right handle form while advancing the adjustment handle over the threads on the axle shaft to increase compression force and therefore force resistance of the exercise tool.

DETAILED DESCRIPTION OF THE INVENTION

In various embodiments described in enabling detail herein, the inventor provides a unique isometric force resistive exercise tool that enables working various groups of upper body muscles at graduating force resistance levels by using a single hand-operated adjustment interface. A goal of the invention is to provide a resistance tool that may be used work the hands, wrists, fingers, arms, and shoulders without device modifications. It is a further goal of the present invention to provide a method and apparatus of resistive force adjustment of an isometric exercise device that enables smooth granular graduation on a scale from little to no force resistance level to a maximum achievable force resistance level. A further goal of the present invention is to provide an isometric exercise device for working the various muscle groups described above that contains durable components resistive to wear and weathering. The present invention is described using the following examples, which may describe more than one relevant embodiment of the present invention.

Figure 1A:
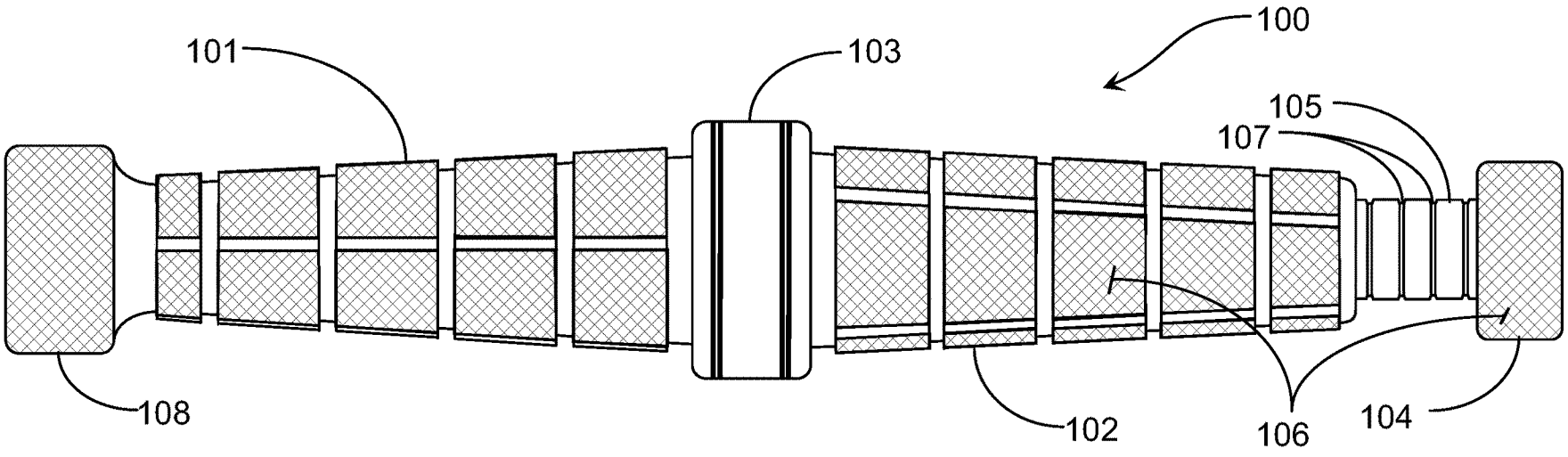
FIG. 1A is a side-elevation view of a grip and twist force resistance device according to an embodiment of the present invention.

FIG. 1A is a side-elevation view of a grip and twist isometric force resistance device 100 according to an embodiment of the present invention. Grip and twist isometric resistance device 100 is a force resistant assembly comprising four basic components assembled to form. Isometric resistance device 100 may be referred to hereinafter in this specification as a twister grip assembly 100. Twister grip assembly 100 is adapted as an elongated annular form and includes a left grip handle form 101. Handle form 101 has a tapered and substantially hollowed body having a materially contiguous annular grip knob 108 at one end and a concentric piston form (not visible) at the opposite end.

Grip twist assembly 100 includes a right handle form 102 having a like tapered and elongated, substantially hollow body as handle form 101. Right handle form 102 includes a materially contiguous ring housing 103 open at the free end thereof and adapted to receive the piston form of left grip handle form 101 in a slip fit and concentric relationship. Left handle form 101 and right handle form 102 may be fabricated of a durable lightweight aluminum and crafted into form by machining process. Left handle form 101 and right handle form 102 are held together in assembly by a threaded longitudinal axle shaft (not visible).

Right handle form 102 is open at the end opposite ring housing 103 and is adapted to receive the stem portion 105 of a force resistance adjustment knob 104 in a slip fit and concentric relationship. Adjustment knob 104 has a hollowed interior (bore not visible) including interior threading at the end of stem 105 that may be threaded onto the end of the axle shaft holding left handle form 101 to right handle form 102. Adjustment knob 104 and stem 105 are in this embodiment, materially contiguous and like the handle forms may be fabricated from a durable lightweight aluminum crafted into form by machine process. Although not visible in this view, the axle shaft extends through a central opening in the piston form of the left handle form and is welded to an annular pressure plate that is somewhat larger in diameter than the diameter of the opening at center of the piston form.

Grip twist assembly 100 may include friction-resistive materials disposed within ring housing 103 and within the bore of left handle form 101 ahead of the pressure plate (internal components not visible). Twist grip assembly 100 includes a surface knurling 106 in this embodiment to aid in a no slip grip of the respective handle forms 101 and 102. The tapered handle forms 101 and 102 when assembled present an opposing taper down having the largest diameter at ring housing 103 and tapering down to left handle grip knob at the end of handle form 101 and to the stem (105) receiving end of handle form 102. Adjustment handle 104 may interface with a pair of industrial springs placed over the axle shaft and contained in the hollow longitudinal bore within handle form 102 along with a polymer sleeve and a polymer washer serving as a spring compression stop.

In full assembly, left handle form 101 and right handle form 102 may be rotated against friction force that is fully adjustable by threading on or threading off adjustment handle 104 relative to the axle shaft. Stem 105 of adjustment handle 104 may include three or more annular grooves referred to herein as gauge rings 107. Gauge rings 107 may be equally spaced apart and the distance between each ring-to-ring may represent a threading travel distance relative to adjustment handle 104 being advanced over the external trading of the axle shaft. In this embodiment, an operator may turn adjustment handle clockwise to increase back pressure of a piston form face and the face of the pressure plate against the friction-resistive materials fixedly disposed at the bottoms of respective bores in each handle form. Turning adjustment handle 104 counterclockwise reduces back pressure against the resistive materials alluding to decompression of the industrial springs inside the assembly.

An operator may grip the respective handle forms and may rotate them in opposite directions against a previously set resistance level visible by the travel distance of adjustment handle stem 105 into the receiving end of handle form 102. The opposing taper or conical profile of the assembled handle forms provides a comfortable grip with gloves or bare hands. In use, an operator my set a resistance force using the adjustment handle 104 and perform repetitive grip and twist motions against the resistive friction force created by the back pressure urged by spring compression against a stop. In this embodiment, a user may make unlimited rotations in a same direction, on either the right or left side of the device. This is a marked improvement over devices known in the art, as most are limited to a single rotation in any direction before having to rotate in the opposite direction.

The operator may vary the held position of twist grip tool or assembly 100, for example working it horizontal to the operator's stance or vertical to the operator's stance encompassing the shoulder muscle group as well as the forearms, biceps, wrists, and hands. An operator may start at a previously set level of small force resistance and adjust the tool to a next level of force resistance between repetitions. Adjustment handle 104 enables micro-granular levels of force resistance from zero to maximum force resistance where the industrial springs are at full compression (designed amount), which proportionally increases the friction resistance against the resistive materials within the tool. In one embodiment, twist grip assembly may be manufactured for different levels of strength by selecting a gauge for the industrial springs and or shortening the length that the springs might be compressed.

Figure 1B:
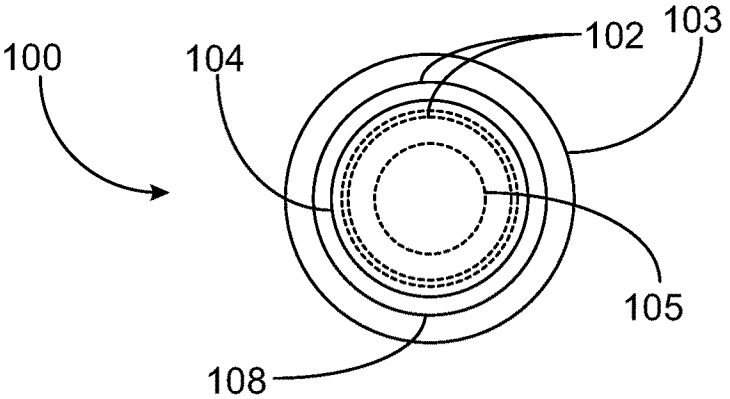
FIG. 1B is a right-end view of the grip and twist device of FIG. 1A.

FIG. 1B is a right-end view of grip and twist device 100 of FIG. 1A. Grip twist assembly 100 is an annular form on this embodiment. An annular form is a preferred embodiment for both manufacturing and for ergonomic operation of the device.

However, this should not be construed as a limitation to the practice of the present invention. The outer shell of the grip and twist assembly 100 may be shaped in other geometric forms without departing from the spirit and scope of the present invention.

Ring housing 103 has the largest diameter of the grip twist assembly at approximately three inches followed by the left handle grip knob 108 having approximately a two and three-eights-inch diameter, which is the same diameter in this example as the highest point of right handle form 102. Handle stem 105 is the smallest diameter of the outwardly visible features of grip twist assembly 100 at approximately one and one-eight inches in diameter. All of the visible forms of grip twist assemble 100 are held in concentric relationships including the internal components described in more detail below.

Figure 2:
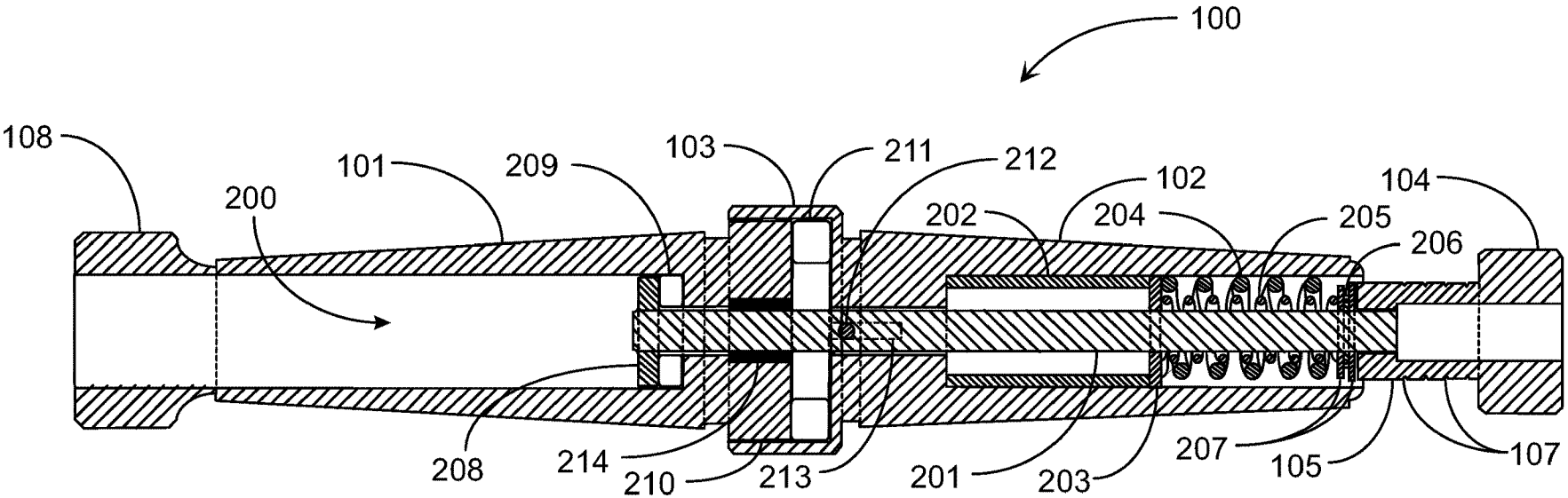
FIG. 2 is a sectioned view of the grip and twist device of FIG. 1A.

FIG. 2 is a one-half-sectioned view of grip and twist device 100 of FIG. 1A. Grip twist assembly 100 sectioned, depicts right handle form 102 receiving a piston form 210 of left handle form 101 within the internal space of ring housing 103 of handle form 102. Ring housing 103 may be a modular part, in one embodiment, that is fixed to handle form 101, or welded to handle form 102. Ring housing 103 may be materially contiguous with handle form 102 in a preferred embodiment. A friction resistive material 211 is provided and is disposed at the bottom of ring housing 103. Friction resistive material 212 may be in the form of a rough fibrous material like nylon rope material or a solid form of a material that has frictional resistive properties.

A centrally disposed axle shaft 201 is provided to hold the handle forms together in an assembly. Axle shaft 201 extends from a threaded connection to adjustment handle 104 (connected at stem 105) through a central bore opening provided through center of the solid material features of the handle forms and into a lager bore space 200 that bottoms out some distance behind solid piston form 210 that interfaces with ring housing 103. A smaller amount of a friction-resistive material 209 may be fixedly disposed around the bottom of bore 200 in the form of a ring of friction resistive fibrous material or solid form. In a preferred embodiment, resistive material 211 and resistive material 209 are the same material. However, that should not be construed as a limitation of the present invention.

Axle shaft 201 extends through a disc form pressure plate 208 and may be welded to a backside of pressure plate 208 to stabilize the plate. Pressure plate 208 may be a disc form with an internal threading that may be threaded over axle shaft 201 to a position on the threads and then welded thereto. Bore 200 may be capped at the end of Left handle form 101 using a plastic cap that may be snapped into the diameter of the bore. Similarly, a plastic end cap may be provided to cap the opposite center-bored end of the grip twist assembly 100 at the end of adjustment handle 104.

In this embodiment, a catch pin 212 is provided and pressed through axle shaft 201 presenting orthogonally to the longitudinal axis of axle shaft 201. Catch pin 212 may be welded into place and has a length longer that the diameter of axle shaft 201 extending beyond the shaft on opposite sides. A catch pins slot is provided at the bottom of ring housing 103 by machine process to a depth into the center opening for the axle shaft and of a length to fully secure the length of catch pin 212. Catch pin slot 213 may capture catch pin 212 in order to secure the catch pin therein on both sides of the shaft and therefore lock axle shaft 201 to right handle form 102 in correct assembly of grip twist tool 100 preventing handle form 102 from rotating about axle shaft 201.

A large diameter industrial spring 204 is provided and placed over axle shaft 201 and is contained within a center bore placed into right handle form 102 and bottoming out some distance before ring housing 103. The center bore in right handle form 102 may be the same diameter of bore 200 in the left handle form 101. A polyvinyl chloride (PVC) or nylon sleeve 202 is provided as a bore space filler material or spacer enabling more material to be removed from handle form 102 to reduce material weight in line with handle form 101 and center bore 200.

Smaller diameter industrial spring 205 may be placed over axle shaft 201 against flat nylon washer 203 abutted against the forward rim of nylon sleeve 202. Larger diameter industrial spring 204 may be placed over both the axle shaft 201 and the smaller diameter spring 205 abutting against the same nylon washer 203. In one embodiment, smaller diameter industrial spring 205 is longer than larger diameter spring 204 and during force resistance adjustment, may be the first spring compressed for a specific distance before both springs are compressed. The open face of adjustment handle stem 105 abuts one of pair of steel washers 207 placed over axle shaft 201 and sandwiching a flat bearing disc 206. Industrial springs 204 and 205 may abut the first steel washer 207 with the smaller spring 205 being compressed against the washer before the larger spring 204 contacts the washer. In this view, both larger spring 204 and smaller spring 205 are in a state of compression due to clockwise advancement of adjustment handle 104.

In general, use of grip twist assembly 100 involves adjusting the level of force resistance characterized herein as an adjustable level of a resistive state of the assembly relative to force required to grip and twist the left and right handle forms in opposite directions. Adjustment handle 104 may be turned clockwise to increase this level of force resistance, or counterclockwise to reduce the level of force resistance. Placing the industrial springs 204 and 205 under compression using the adjustment handle 104 to advance over axle shaft 201 causes piston form 210 of left handle form 101 to compress against friction-resistive material 211. At the same time, pressure plate 208 compresses against friction-resistive material 209 requiring more twist force to twist the respective handle forms relative to one another.

Figure 3A:
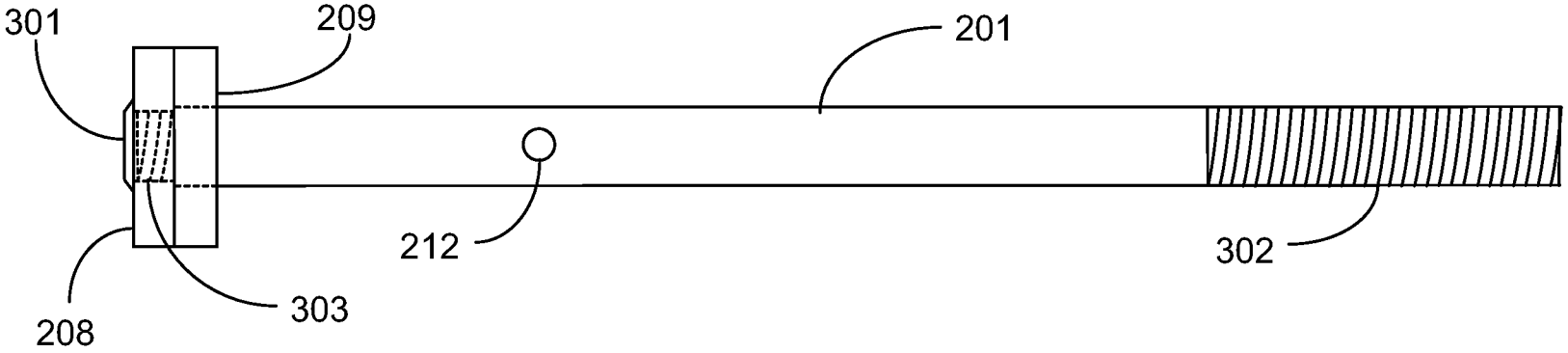
FIG. 3A is an elevation view of the axle shaft of the resistance device of FIG. 2.

FIG. 3A is an elevation view of axle shaft 201 of grip twist assembly 100 of FIG. 2. Axle shaft 201 has a section thereof threaded externally with threads 302 extending a distance from the end of the shaft inward. Threads 302 match female threading provided in the stem 105 of adjustment handle 105 (see FIG. 2). Catch pin 212 extends through axle shaft 201 and extends in pin length past the diameter of the axle shaft on both sides of the shaft.

In one embodiment, axle shaft 201 includes an external thread pattern 303 at the end opposite the adjustment handle. In this embodiment, pressure plate 208 may have a female matching thread pattern and may be threaded onto the end of axle shaft 201 before being welded thereto by applying a weld cap 301 via a welding process. Although friction-resistive material 209 is depicted on axle shaft 201 adjacent to and abutting pressure plate 208, the depiction is logical only. In actual practice the resistive material 209 is disposed at the bottom of the center bore space 200 of the left handle form 101. In one embodiment, friction-resistive material 209 may be placed in a relative shallow counter bore placed at the bottom center of the bore space and fixed therein by gluing the material in place for example. In dissemblance of the grip twist assembly, axle shaft 201 is removed from the left handle form without friction-resistive materials 209 separating from the left handle form.

Figure 3B:
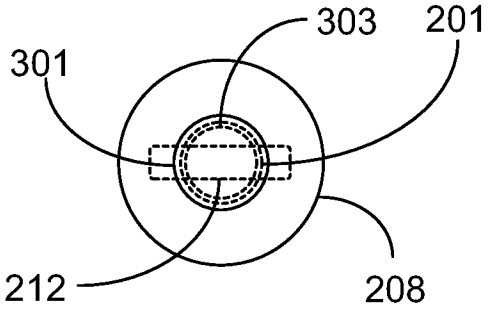
FIG. 3B is a left-end view of the axle shaft of FIG. 3A.

FIG. 3B is a left-end view of axle shaft 201 of FIG. 3A. Pressure plate 208 may be about one and one-eight inches in diameter and fits into the central bore (200, FIG. 2) with a concentric tolerance of about a tenth of an inch between the edge of the pressure plate and the inside diameter of the bore space. Resistive material 209 may take up all of the bore diameter and is not illustrated in this view. Weld cap 301 may simply be two opposite tack welds holding pressure plate 208 to axle shaft 201 at the advanced position on external threads 303. An operator may remove axle shaft 201 from the left handle form by completely detaching the adjustment handle from the opposite end. It may then be pulled out of the handle form through the open end of the bore space. A plastic cap may be provided to hide the open bore. Pressure plate 208 may be fabricated from steel or aluminum alloy without departing from the spirit and scope of the invention.

Figure 4:
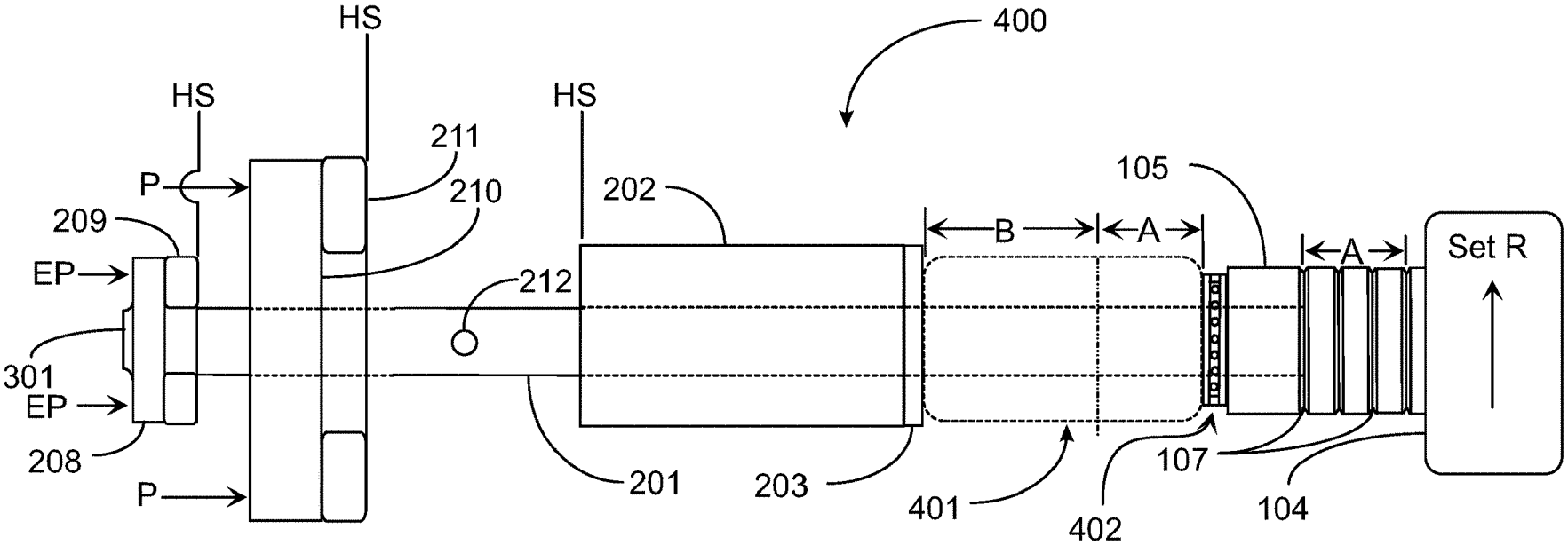
FIG. 4 is a block diagram depicting mechanics of setting force resistance for the grip and twist device of FIG. 1A.

FIG. 4 is a block diagram depicting mechanics of setting force resistance for grip and twist assembly 100 of FIG. 1A. Block diagram 400 depicts logical representations of the components of grip twist assembly 100. Starting with a level of no resistance, an operator may turn adjustment handle 104 clockwise in the direction of the arrow to increase the force resistance of the assembly. Gauge rings 107 define a general distance A that adjustment handle 104 may travel on the external threads of axle shaft 201. The industrial spring set introduced and described further above (FIG. 2 springs 104,105) is represented logically herein as spring set 401 (broken boundary). Distance A is roughly equal to a distance A representing a compression distance against spring set 401.

Spring set 401 may be compressed against a bearing component 402 (analogous to washers 207 and bearing plate 206 of FIG. 2, nylon washer 203, and nylon sleeve 202 placed in the bore of the right handle form (102 not depicted). A hard stop (HS) represents the bottom of the center bore. Bearing component 402 enables adjustment handle 104 to be turned easily with the fame force used as compression against spring set 401 is increased.

Distance B may represent the shortened length of spring set 401 in a maximum state of compression. Any state of compression of spring set 401 is translated to axle shaft 201 and causes equal pressure (EP) of pressure plate 208 acting against resistive material 209 disposed at the bottom of the center bore in the left handle form (FIG. 2, handle form 101, bore space 200). Likewise, piston form 210 of the left handle form is caused to exert a proportional amount of pressure (P) against friction resistive material 211 disposed at the bottom of the ring housing of the right handle form (FIG. 2, handle form 102, ring housing 103) against a hard stop (HS) representing the bottom surface of the ring housing.

The amount of force resistance set for the grip twist assembly references the level of twist resistance created by adjustment handle 104 compressing spring set 401 any amount along adjustment handle travel distance A translating to compression distance A in spring set 401. The level of force resistance created by turning adjustment handle 104 clockwise may depend somewhat upon the selected gauges of the springs in spring set 401 and somewhat on the friction resistive attribute of the selected friction-resistive material(s) chosen for the assembly. In one embodiment, adjustment handle 104 may be temporarily locked in place on the external thread pattern of axle shaft 201 with a handle turn-lock mechanism (not illustrated) to prevent an undesired change in force-resistant level set by the adjustment handle while working the grip twist assembly.

One with skill in the arts will recognize that the outer handle forms of a grip twist assembly like assembly 100 may be designed differently and that the overall length attribute of such an assembly may be different and further, that the overall amount of force resistance an assembly is capable of may be derived in part by materials selection of a spring set, selection of the resistive materials used, and in part by the travel/compression distance afforded in the adjustment handle relative to the axle shaft thread pattern length that may be navigated. Therefore, the grip twist isometric fore resistant exercise tool of the present invention may be provided in different models or designs with differentiating levels of capability relative to force resistance. Design metrics may include changing length of handle forms, changing diameter and taper metrics of handle forms, changing surface metrics of handle forms with respect to operator grip metrics, and so on.

Figure 5:
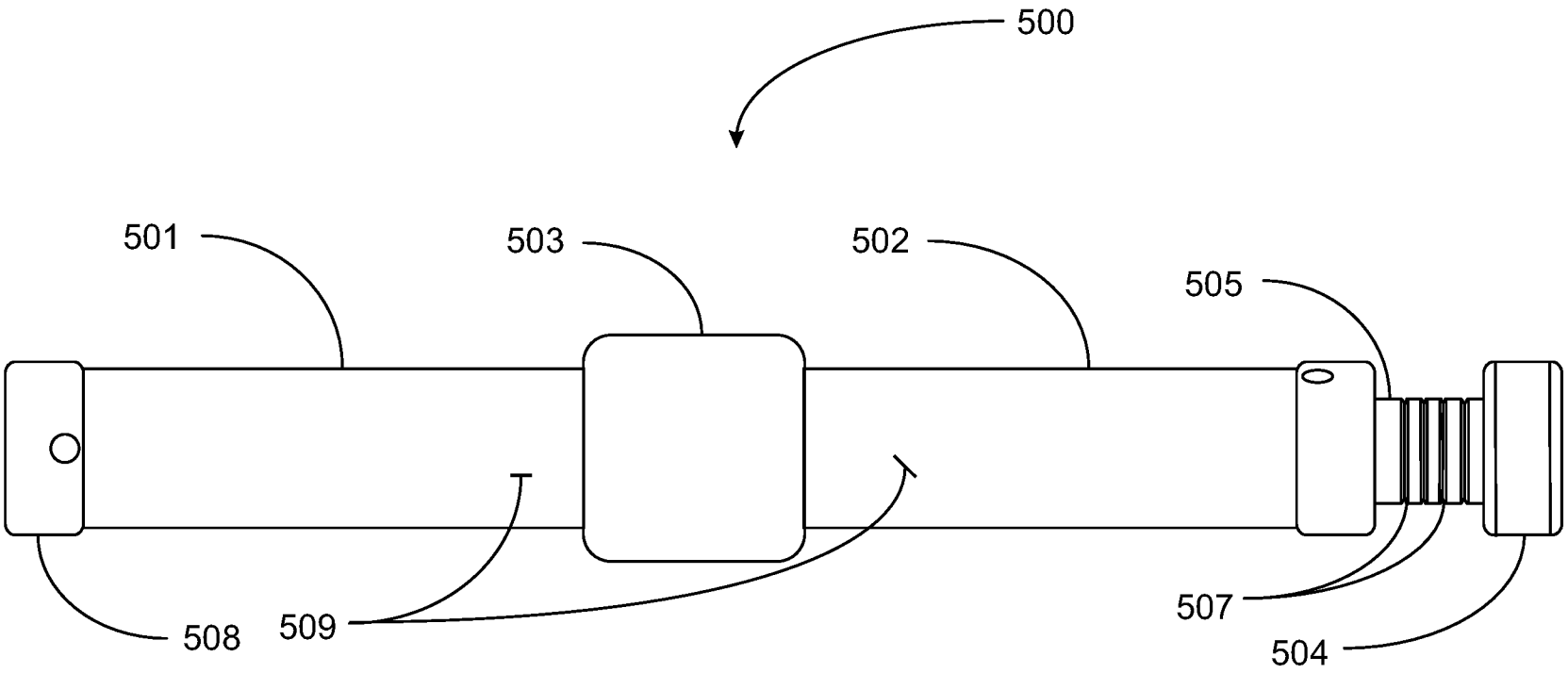
FIG. 5 is a side-elevation view of a grip and twist force resistance device according to a variant embodiment.

FIG. 5 is a side-elevation view of a grip and twist isometric force-resistance assembly 500 according to another embodiment of the invention. Grip and twist assembly 500 includes a left handle form 501 and a right handle form 502 with a ring housing 503. Adjustment handle 504, including handle stem 105 and ring gauge grooves 507 are analogous to counterparts of FIG. 1A. Left handle grip knob 508 is roughly the same diameter as adjustment handle 104. The general profile is a straight non-tapered profile and grip material 509 like polyurethane sleeves may be utilized for grip metrics over a knurled grip surface. Grip material 509 may also cover grip knob 508 and adjustment handle 504, for example neoprene "no-mark" rubber.

Figure 6:
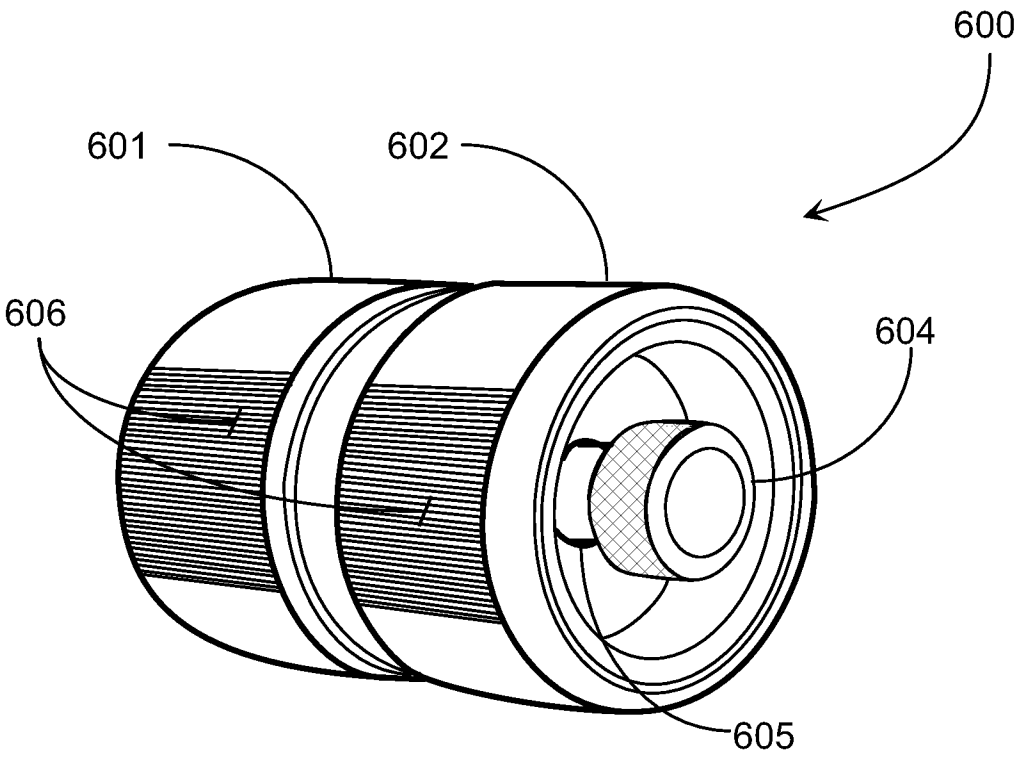
FIG. 6 is a perspective view of a grip and twist force resistance device according to a further variant embodiment.

FIG. 6 is a perspective view of a grip and twist isometric force-resistance assembly 600 according to a further variant embodiment. Grip and twist assembly 600 includes a left handle form 601 and a right handle form 602, the handled forms spaced apart over the axle shaft by a spacer disc or disc set (not visible). I this variant embodiment there is no ring housing on the right handle form and no piston form on the left handle form to interface. In this embodiment, there may be tandem pressure plate interfaces for the left handle form and the right handle form the pressure plates and friction resistive materials hidden entirely within the respective handle forms.

Adjustment handle 604 including adjustment handle stem 605 may be analogous with handle 104 and handle stem 105 of FIG. 1A. In this view, ring gauge grooves are not depicted on handle stem 605 but may be assumed present in some embodiments. In this variant design, the overall length of the grip twist assembly 600 is significantly shorter in overall length than other depicted designs focusing the operator on a shorter placement of the hands closer together when exercising with the tool.

Assembly 600 may be a product of a straight handle design with no taper, the handle forms generally being larger diameter forms than with other device models. In this design different muscle groups may be worked as a result of the much shorter design length and perhaps larger diameter handle forms. The outer surface of adjustment handle 604 may be knurled for improving grip. In this embodiment, a different grip enhancing pattern may be leveraged in substantially parallel ridges 606 provided in the outside surfaces of the handle forms over a section of or over all of the form surfaces.

In this embodiment, the ring housing may have the same outside diameter has the right handle form 602 and may not be discernible from a vantage point the outside of the handle form. The piston form of left handle form 601 may also be sized in diameter to fit inside the ring housing on the right handle form. Friction resistance material may be disposed at the back of the ring housing on the right handle form. The pressure plate and friction resistance material in the left handle form may be analogous to that described in FIG. 2 where in this case left handle form 601 includes a center bore at a similar or at a larger diameter.

Figure 7:
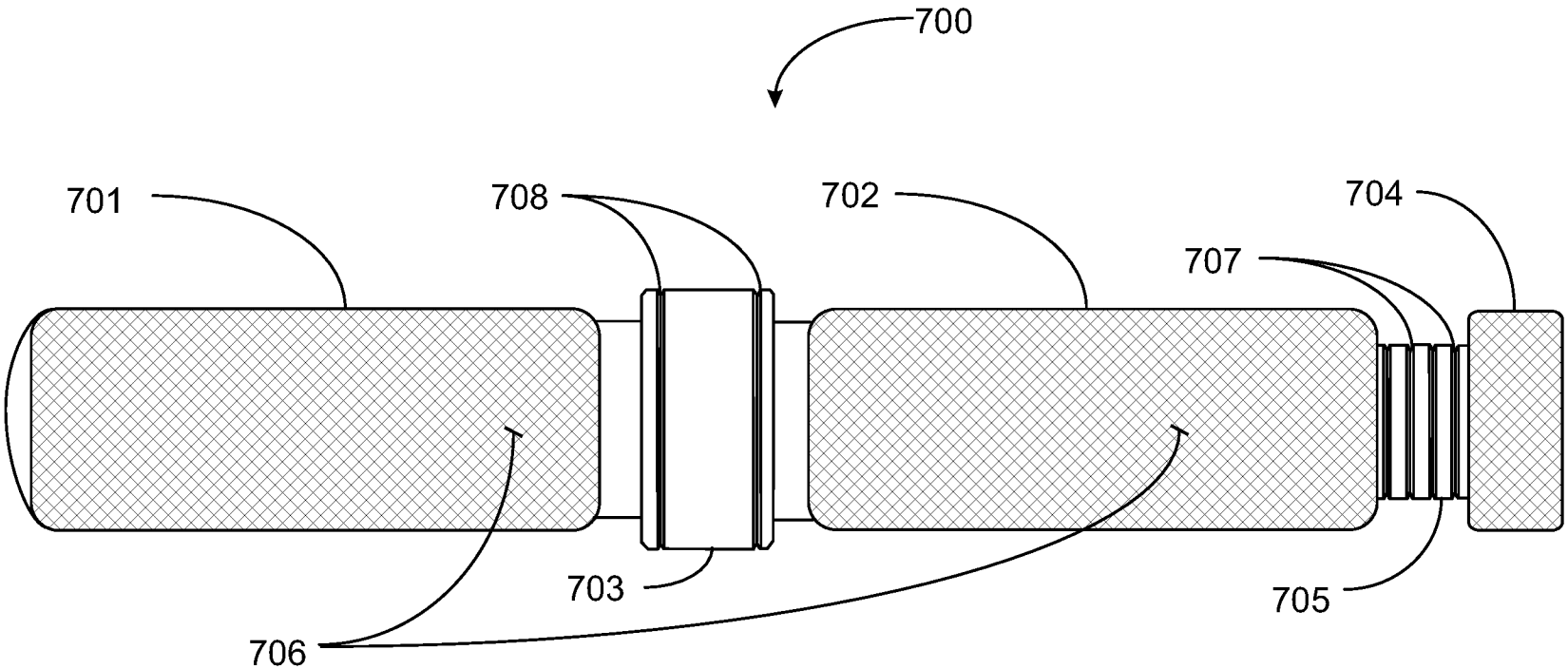
FIG. 7 is a side-elevation view of a grip and twist force resistance device according to a further variant embodiment.

FIG. 7 is a side-elevation view of a grip and twist isometric resistance assembly according to a further variant embodiment. Grip and twist assembly 700 includes a left handle form 701 and a right handle form 702 with a ring housing 703. Adjustment handle 504, including handle stem 105 and ring gauge grooves 507 are analogous to counterparts of FIG. 1A. In this embodiment left handle form 701 has no grip knob.

In this straight design, all of the annular components have the same uniform outside diameter with the exception of ring housing 703 having a larger diameter. The general profile of grip twist assembly 701 is a straight non-tapered profile. Left handle form 701, right handle form 702, and adjustment handle knob 704 all include a knurl pattern to aid in a slip resistant grip by the operator. Ring housing 703 is a contiguous extension of right handle form 702 and receives a piston form (not visible) contiguous to the left handle form 701. Adjustment handle 704 including handle stem 705 and ring gauge grooves 707 are analogous to the descriptions of counterpart elements described in reference to FIG. 1A. In this view, design radial grooves 708 are provided around the outer diameter surface of ring housing 703 for aesthetic purposes.

It will be apparent with skill in the art that the grip twist isometric workout tool of the present invention may be provided using some or all the elements described herein. The arrangement of elements and functionality thereof relative to the invention is described in different embodiments each of which is an implementation of the present invention. While the uses and methods are described in enabling detail herein, it is to be noted that many alterations could be made in such details of construction or design and arrangement of the elements without departing from the spirit and scope of the present invention. The present invention is limited only by the breadth of the claims below.

The invention claimed is:

1. An isometric exercise tool comprising:

an elongate left handle form having a central opening placed longitudinally there through and a bore space provided concentric with the central opening, the bore space opening out at one end of the left handle form and terminating before an interfacing end of the left handle form, the left handle form including a piston form serving as the interfacing end of the handle form;

an elongate right handle form having a central opening placed longitudinally there through and a bore space provided concentric with the central opening, the bore space opening out at one end of the handle form and terminating before an interfacing end of the right handle form, the right handle form including a ring housing serving as the interfacing end of the right handle form, the ring housing having an inside diameter larger than the outside diameter of the piston form to receive the piston form concentrically therein;

an axle shaft disposed longitudinally through the central openings through the left and right handle forms, the axle shaft including an external thread pattern disposed at one end and a pressure plate having a central opening placed there through disposed at the other end, the pressure plate disposed over the axle shaft orthogonal to the axle shaft and welded or otherwise fixed thereto;

at least one compressible spring or set of compressible springs having an outer diameter smaller than the inner diameter of the bore space of the right handle form, the spring or spring set fitted over the axle shaft at the threaded end;

an adjustment turn handle including a handle knob and a smaller diameter handle stem with a central opening placed there through the center opening including a female thread pattern matching the external thread pattern on the axle shaft; and a friction-resistive material disposed to and fixed around the bottom of the bore space in the left handle form and disposed to and fixed around the bottom of the ring housing of the right handle form;

whereby an operator may set the level of resistive force of the exercise tool by advancing the adjustment handle a distance over the thread pattern on the axle shaft to compress the spring, the compression force translating through the axle shaft to the piston form and pressure plate in tandem causing directly proportional compression force of the piston form and pressure plate against the disposed friction-resistive materials.

2. The isometric exercise tool of claim 1, wherein the left and right handle forms are tapered conically downward from the interface in assembly to the free ends of the handle forms.

3. The isometric exercise tool of claim 1, wherein the axle shaft further including a catch pin pressed or otherwise inserted through an opening placed orthogonally through the axle shaft and fixed thereto, the length thereof extending past the diameter of the axle shaft on opposite sides, and a catch pin slot provided in the bottom center of the ring housing on the right handle form, the catch pin slot extending a depth into the material and having a sufficient slot length and slot width to receive the catch pin locking the right handle form to the axle shaft and preventing rotation of the right handle form about the axle shaft.

4. The isometric exercise tool of claim 1, further including an annular sleeve having a cut length, an outside diameter, and a wall thickness, and a washer having an outside diameter similar to or the same as the annular sleeve, a thickness, and an inside diameter larger than the outside diameter of the axle shaft the sleeve inserted into the bore space of the right handle form followed by the washer serving as a filler of space in the bore and a hard stop against the spring.

5. The isometric exercise tool of claim 1, wherein the handle stem of the adjustment turn knob includes a plurality of ring grooves having a uniform depth and placed about the outer surface of the handle stem the grooves equally spaced apart along the handle stem to mark off travel distance of the adjustment handle.

6. The isometric exercise tool of claim 1, wherein the friction-resistive materials are rings having an outside diameter, an inside diameter, and a thickness, the rings fixed in place at the bottom of the center bore of the left handle form opposite the pressure plate of the axle shaft, and at the bottom of the ring housing of the right handle form opposite the piston form of the left handle form.

7. The isometric exercise tool of claim 1, wherein the resistive material is a fibrous synthetic rope material.

8. The isometric exercise tool of claim 1, wherein the friction resistive material is a solid form of material having friction resistive attributes or characteristics.

9. The isometric exercise tool of claim 1, wherein the resistive material disposed in the left handle form bore space is seated into an annular depression at the bottom of the center bore.

10. The isometric exercise tool of claim 1 further including a frictional bearing unit disposed over the axle shaft, the bearing unit comprising two washers and a bearing plate disposed there between, the bearing unit abutting the end of the handle stem of the adjustment handle on one side and the spring on the other side.

11. The isometric exercise tool of claim 1, wherein the spring is a spring set including a large diameter spring placed over a smaller diameter spring, the smaller diameter spring having a longer overall uncompressed length than that of larger diameter spring.

12. The isometric exercise tool of claim 1, wherein the left handle form, the right handle form, and the adjustment handle are fabricated of a lightweight aluminum material.

13. The isometric exercise tool of claim 12, wherein the left handle form, right handle form, and adjustment handle have knurled outer peripheral surfaces.

14. The isometric exercise tool of claim 1, wherein the force resisted is a bidirectional twisting force exerted upon the left and right handle form.

15. A method for exercising one or more muscle groups using an isometric exercise tool, the isometric exercise tool having a left handle form interfaced to a right handle form over an axle shaft locked to the right handle form, the axle shaft supporting a pressure plate, a compressible spring, and a compression adjustment handle threaded onto the axle shaft and abutting the compressible spring, the pressure plate adjacent in assembly to a friction-resistive material fixed on the left handle form, the left handle form including a piston form interfacing with a ring housing on the right handle form, the piston form adjacent in assembly to a friction-resistive material fixed on the right handle form comprising:

(a) turning the compression adjustment handle to advance the handle along threads of the axle shaft the compression handle compressing the spring or spring set to compress the pressure plate and piston form in tandem against the friction resistive materials;

(b) gripping the left handle form and the right handle form and twisting the forms in opposite direction;

(c) determining if the level of force resistance set by the adjustment handle is correct for the exercise;

(d) if the level of force resistance set in (c) is not correct, advancing or retarding the compression adjustment handle and repeating step (b); and (e) if the level of force resistance set in (c) or corrected in (d) is correct, repeating step (b) for a number of repetitions.

16. The method of claim 15, wherein the friction-resistive materials are rings having an outside diameter, an inside diameter, and a thickness, the rings fixed in place at the bottom of a center bore of the left handle form opposite the pressure plate of the axle shaft, and at the bottom of the ring housing of the right handle form opposite the piston form of the left handle form.

17. The method of claim 15, wherein the spring is a spring set including a large diameter spring placed over a smaller diameter spring over the axle shaft, the smaller diameter spring having a longer overall uncompressed length than that of larger diameter spring.

18. The method of claim 15, wherein in (a) the handle is turned clockwise to increase compression.

19. The method of claim 15, wherein in (c) the determination of the level of force resistance is made as a result of practicing (b) and quantifying the force resistance level.

20. A method for exercising one or more muscle groups using an isometric exercise tool, the isometric exercise tool having a left handle form interfaced to a right handle form over an axle shaft locked to the right handle form, the axle shaft supporting a pressure plate, a compressible spring or set of springs, and a compression adjustment handle threaded onto the axle shaft and abutting the compressible spring or spring set, the pressure plate adjacent in assembly to a friction-resistive material fixed on the left handle form, the left handle form including a piston form interfacing with a ring housing on the right handle form, the piston form adjacent in assembly to a friction-resistive material fixed on the right handle form comprising:

(a) turning the compression adjustment handle to advance the handle along threads of the axle shaft, the compression handle compressing the spring or spring set to compress the pressure plate and piston form in tandem against the friction resistive materials;

(b) determining if the level of force resistance set by the adjustment handle is correct for the exercise by visualizing a linear gauge of equally spaced grooves provided about a stem of the adjustment handle the grooves subsequently aligning with the end of the right handle form while advancing the adjustment handle over the threads on the axle shaft to increase compression force and therefore force resistance of the exercise tool;

(c) gripping the left handle form and the right handle form and twisting the forms in opposite direction.

* * * * *